US006203383B1

(12) United States Patent
Iby et al.

(10) Patent No.: US 6,203,383 B1
(45) Date of Patent: Mar. 20, 2001

(54) LEVER ACTION BATTERY TERMINAL APPARATUS

(75) Inventors: Lewis C. Iby, Westlake Village; Roger J. Alves, Simi Valley; Fernando Pardo, Moorpark, all of CA (US)

(73) Assignee: Scosche Industries, Inc., Oxnard, CA (US)

( * ) Notice: Subject to any disclaimer, the term of this patent is extended or adjusted under 35 U.S.C. 154(b) by 0 days.

(21) Appl. No.: 09/477,292

(22) Filed: Jan. 4, 2000

(51) Int. Cl.[7] ..... H01R 4/50
(52) U.S. Cl. ..... 439/773; 439/757
(58) Field of Search ..... 439/773, 774, 439/822, 759, 757

(56) References Cited

U.S. PATENT DOCUMENTS 1,596,891 * 8/1926 Rensch ..... 439/757
1,648,914 * 11/1927 Roy ..... 439/773
2,110,918 * 3/1938 Roberts ..... 439/773
3,568,139 * 3/1971 Delzer ..... 439/773
4,695,118 * 9/1987 Magdesyan et al. ..... 439/773
5,269,709 * 12/1993 Eriksson ..... 439/773

* cited by examiner

*Primary Examiner*—Tulsidas Patel
(74) *Attorney, Agent, or Firm*—William W. Haefliger

(57) ABSTRACT

A lever controlled battery terminal connection, comprising a body having upper and lower portions, said lower portion defining a re-entrant recess to receive a battery terminal post, a lever carried by the body to pivot relative to said body upper portion and relative to said recess, the lever having one pivoted position wherein clamping force is transmitted to the post by the lever.

8 Claims, 3 Drawing Sheets

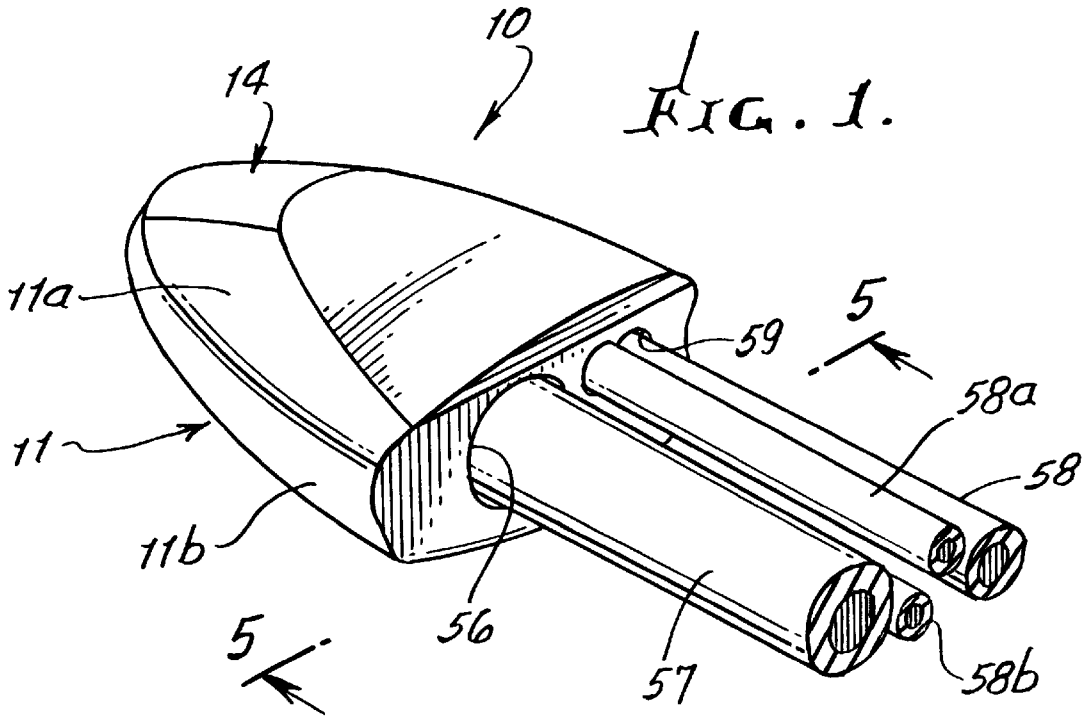
FIG. 1.
FIG. 2.
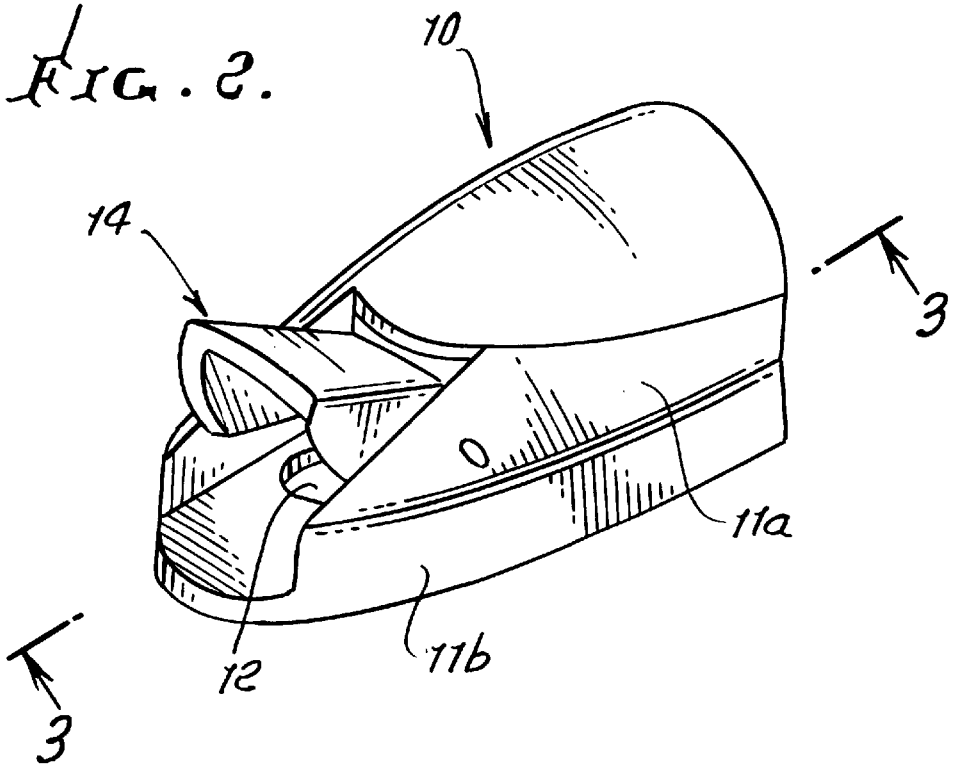

LEVER ACTION BATTERY TERMINAL APPARATUS

BACKGROUND OF THE INVENTION

This invention relates generally to battery terminals and battery terminal connections, as are employed typically in vehicles.

There is need for simple, effective, low cost, reliable, and easily connectible apparatus, for use with battery terminal posts, as in vehicles such as automobiles and trucks. No prior such apparatus of which I am aware embodies the improvements in structure, function and results as are now made possible by the present invention.

SUMMARY OF THE INVENTION

It is a major object of the invention to provide improved apparatus to meet the above need or needs.

Basically, the apparatus of the invention employs lever-controlled battery terminal structure, resulting in mechanical advantage of connection, and includes:

a) a body having upper and lower portions, the lower portion defining a re-entrant recess to receive a battery terminal post, b) a lever carried by the body to pivot relative to the body upper portion and relative to the recess, c) the lever having one pivoted position wherein clamping force is transmitted to the post by the lever.

Typically the lever has another pivoted position wherein the post is released from clamping by the lever.

It is another object of the invention to provide improved structure wherein the lever has a post clamping part at a lower level relative to the body, and a handle at an upper level relative to the body, the handle projecting upwardly in said other pivoted position of the lever. As will be seen, the body upper portion has a top, and said lever handle has a top that is substantially flush with the body top in said one position of the lever.

A further object of the invention is to provide at least one wedge surface on the lever, and which engages an outer surface of the post in said one position of the lever.

Typically, there are two of the wedge surfaces on the lever, and which engage opposed surfaces of the post in the one position of the lever; and the wedge surfaces on the lever are a arcuate about an axis of lever pivoting to progressively engage a lower portion of the post as the lever is pivoted.

Another object is to provide the body in elongated form, with an end remote from the post recess and from the lever wedge surfaces, and there being at least one cable opening in the body and intersecting said end.

The overall structure of the body and lever enables highly protected and safe coverage of the clamped battery terminal post, with over-center lever clamping action, the lever handle combining with the body to cover and protect the point or points of post clamping engagement.

These and other objects and advantages of the invention, as well as the details of an illustrative embodiment, will be more fully understood from the following specification and drawings, in which:

DRAWING DESCRIPTION

FIG. 1 is a perspective view of the top and rear side of the lever action battery terminal; with the lever lowered to clamp the battery terminal post;

FIG. 2 is another perspective view, showing the top and front side, of the lever action battery terminal, with the lever elevated to unclamp the battery terminal post;

DETAILED DESCRIPTION

Figure 3:
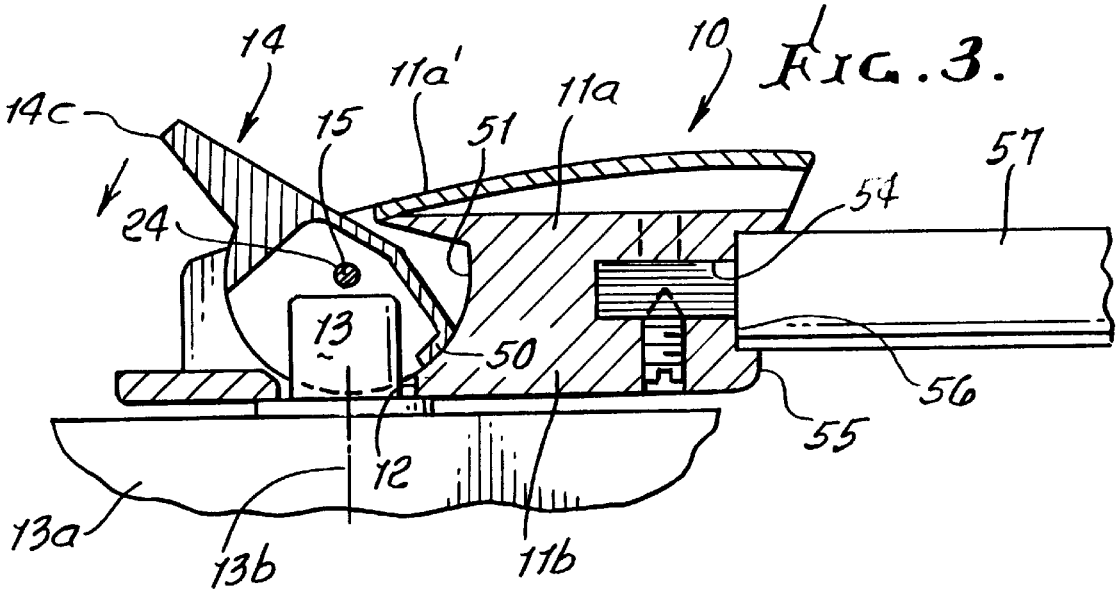
FIG. 3 is an elevation taken in section on lines 3—3 of FIG. 2, the lever being shown elevated.

The lever controlled battery terminal or connection is indicated at 10 in the drawings. It includes:

a) a longitudinally elongated body 11 having upper and lower portions 11*a* and $\mathbf{11}_1$, the lower portion defining a re-entrant recess 12 that extends upwardly in the body to receive a battery terminal post 13, projecting above battery 13*a;* b) a lever 14 carried by the body to pivot relative to the body, and typically about a transverse axis 15, and relative to body recess 12;

c) and the lever having one pivoted position (see FIGS. 4&6) in which clamping force is transmitted to the post by the lever. In another pivoted position (see FIG. 3) of the lever, the post 13 is released from clamping force exertion by the lever.

Figure 4:
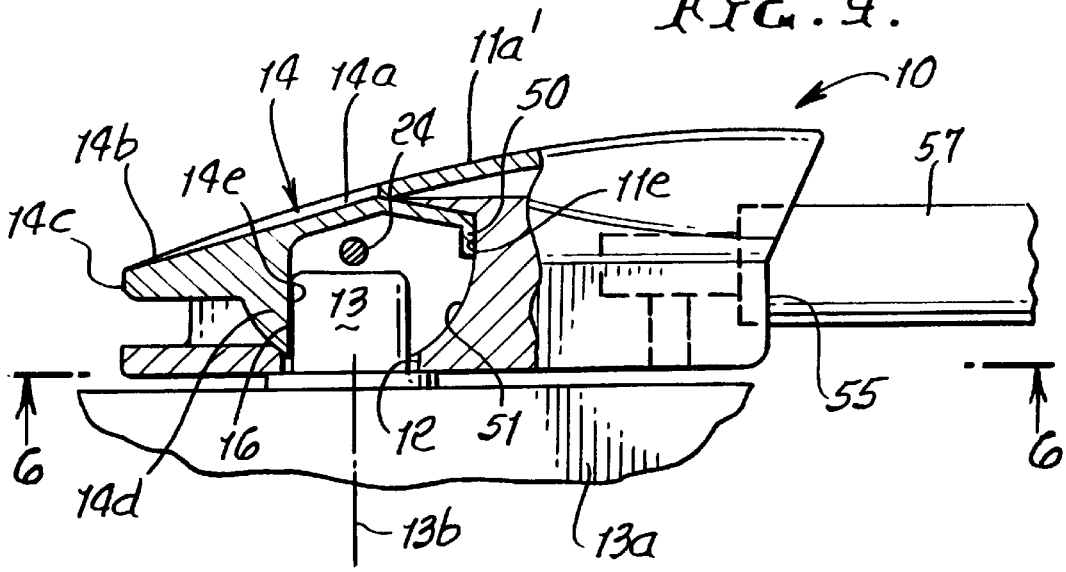
FIG. 4 is a view like FIG. 3, but showing the lever lowered, to clamp the terminal post.
Figure 5:
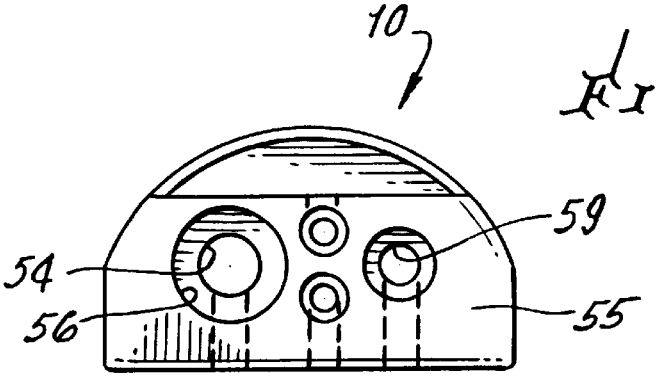
FIG. 5 is a rear end view, taken on lines 5—5 of FIG. 1.

Note that in FIG. 4, the curved top surface 14*a* of the lever is substantially flush with, and provides an extension of, the body domed top surface 11*a*'; and at the same time the terminal 14*c* of the lever handle 14*k* is exposed, for easy lifting, to FIG. 3 position. A lower extension 14*d* of the lever handle projects downwardly in FIG. 4 to provide a forward surface 14*e* facing the post, and it may sidewardly engage the post at 16, as shown, limiting downward pivoting. At that time, the lever structure may extend in over-center locking position, relative to the axis 15, post -13-, and body 11.

In accordance with a further important aspect of the invention, there is at least one wedge surface on the lever, and which engages the outer and lateral surface of the post, with wedge clamping action, in the one position (FIG. 4) of the lever. This enables a progressive tightening clamping action as the lever handle 14 is pivoted downward from FIG. 3 (unlocked) to FIG. 4 (locked) position. Preferably, there are two of such wedge surfaces on the lever, as indicated at 21 and 22, and which engage laterally opposed surfaces of the post to progressively wedge the post between surfaces 21 and 22 as the lever is pushed downwardly to FIG. 4 position. See FIG. 6. Also, surfaces 21 and 22, which are laterally spaced, center the lever between them, and center the apparatus 10 relative to the post, in clamped-up position.

Figure 7:
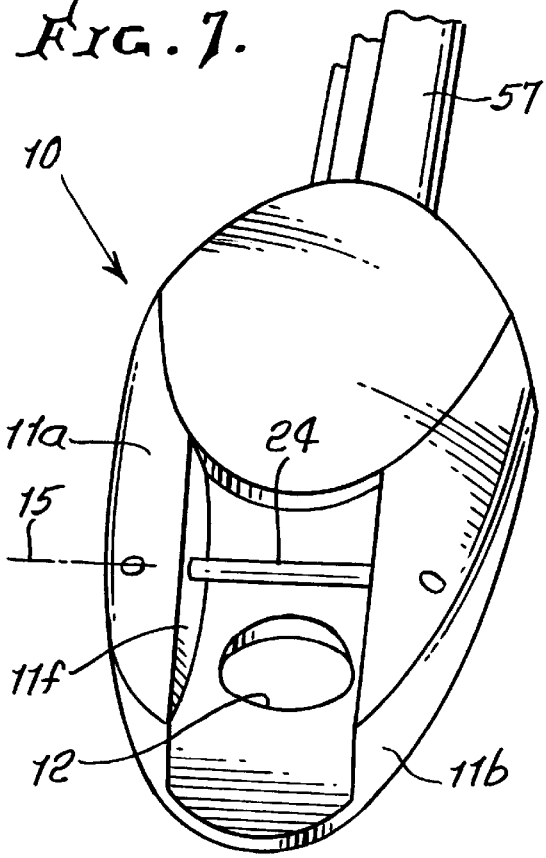
FIG. 7 is a frontal perspective view of the body of the lever action battery terminal, with lever removed to show interior detail.
Figure 8:
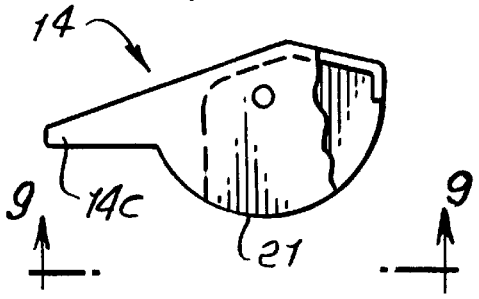
FIG. 8 is a side elevational view of the lever which has been removed in FIG. 7.
Figure 9:
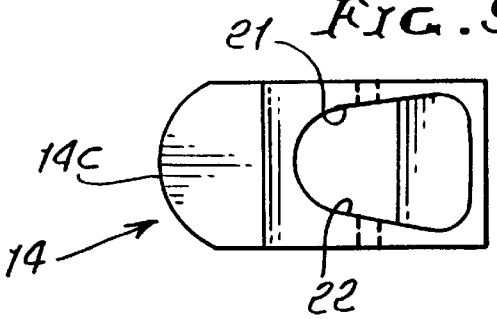
FIG. 9 is a bottom plan view taken on lines 9—9 of FIG. 8, showing wedge surfaces on the lever, and that are arcuate.
Figure 6:
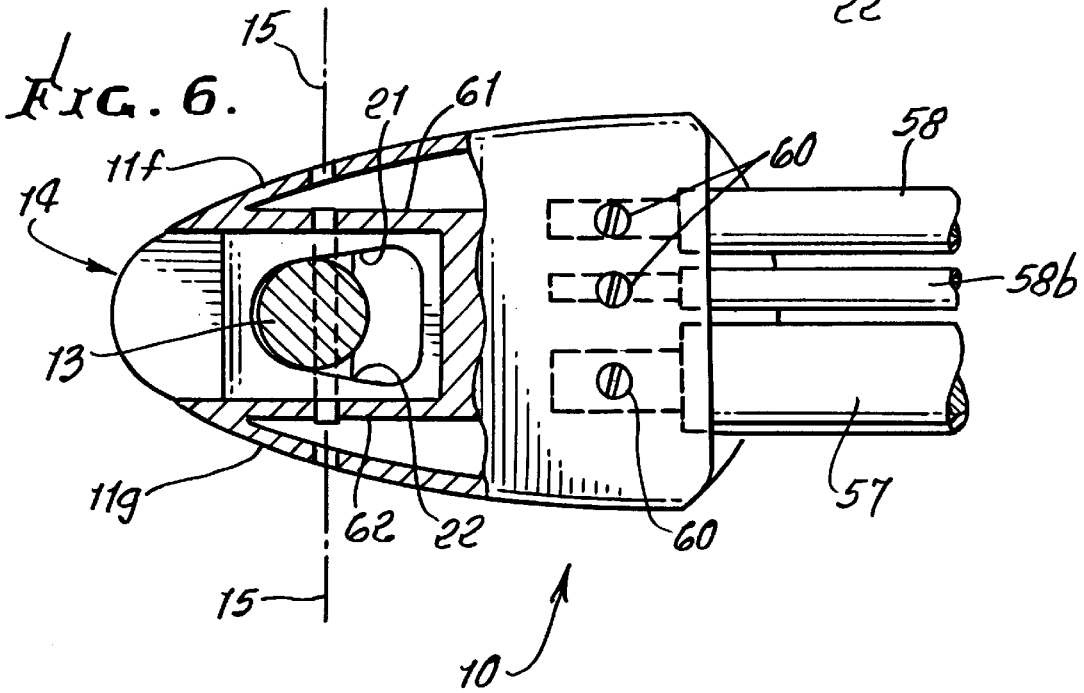
FIG. 6 is a bottom view, partly in section, taken on lines 6—6 of FIG. 4.

Additionally, it will be noted, with further reference to FIGS. 8 and 9, the two wedging surfaces are upwardly and downwardly arcuate about the axis 15 of pivoting, i.e. the axis of the pivot pin 24 extending transversely through the lever and into body sections 11*f* and 11*g*, best seen in FIGS. 6 and 7. Pin 24 extends transversely over the opening or recess 12, whereby the arcuate wedge surfaces (convex downwardly) always engage the post at opposite sides of the post upright axis 13*b* as the lever is pivoted, and as seen in FIGS. 3 and 6. Clamping surfaces 21 and 22 define a modified delta (i.e. Δ) in the projected plan views of FIGS. 6 and 9. Accordingly, a reliable, stable, effective, easily manipulable, and adjustable clamping action is achieved, and provided.

Also shown, as in FIGS. 3 and 4, is the provision of a guide 50 on the lever, remote from the handle. A concave guiding and pushing surface is provided at 51 on the body, so that the guide 50 on the lever can track along surface 51, in guided and stabilized pushing relation, as the lever is pivoted counterclockwise to FIG. 4 position, pushing body 11 to the right as guide 50 flatly engages body flat 11*e* for lock-up, and clamping or weding force is progressively exerted on opposite sides of the battery post.

The body 11 is typically longitudinally elongated and has an end 55 remote from recess 12. At least one cable opening 54 is provided in the body, to face end 55, as at 56. Note battery electrical cable 57 projecting from opening 54, as shown. A similar cable or cables 58, 58*a* and 58*b* project from another opening or openings, or bores 59 in body, and at body end 55. Cable mounting screws are indicated at 60.

FIG. 6 also shows body internal frame members 61 and 62 at opposite sides of the post 13, and acting to support the pivot pin.

From the above and the drawings it will be seen that the preferred device includes:

a) a body having upper and lower portions, said lower portion defining a recess to receive a battery terminal post in a first zone, b) a lever carried by the body to pivot relative to said body upper portion and relative to said recess, about a pivot axis that is directly above the post when received in said zone, c) the lever having one pivoted position wherein wedging clamping force is transmitted to the post by the lever, said lever having a top and projecting handle, d) and wherein said body upper portion has a top, and said lever top is substantially flush with said body top in said one position of the lever, said lever top spaced directly above the uppermost extent of said zone in said one position of the lever, to conceal and protect said zone.

We claim:

1. A lever controlled battery terminal connection, comprising a) a body having upper and lower portions, said lower portion defining a recess to receive a battery terminal post in a first zone, b) a lever carried by the body to pivot relative to said body upper portion and relative to said recess, about a pivot axis that is directly above the post when received in said zone, c) the lever having one pivoted position wherein wedging clamping force is transmitted to the post by the lever, said lever having a top and projecting handle, d) and wherein said body upper portion has a top, and said lever top is substantially flush with said body top in said one position of the lever, said lever top spaced directly above the uppermost extent of said zone in said one position of the lever, to conceal and protect said zone.

2. The lever controlled battery connection of claim 1 wherein the lever has another pivoted position wherein the post is released from clamping by the lever.

3. The lever controlled battery connection of claim 1 including at least one wedge surface on the lever, and which engages an outer surface or surfaces of the post in said one position of the lever.

4. The lever controlled battery connection of claim 3 wherein there are two of said wedge surfaces on the lever, and which engage opposed surfaces of the post in said one position of the lever.

5. The lever controlled battery connection of claim 4 wherein the wedge surfaces on the lever are arcuate about an axis of lever pivoting to engage a lower portion of the post as the lever is pivoted.

6. The lever controlled battery connection of claim 1 wherein the lever has a guide remote from the handle, there being a concave guide surface on the body, and adjacent which the guide on the lever tracks, during pivoting of the lever.

7. The lever controlled battery connection of claim 1 wherein said body is elongated and has an end remote from said recess, and there being at least one cable opening in the body and intersecting said end.

8. The lever controlled battery connection of claim 1 wherein the body has a domed top surface, and the lever has a top surface substantially flush with said body domed surface in said one pivoted position of the lever.

* * * * *